US007247061B2

(12) United States Patent
Hoxha et al.

(10) Patent No.: US 7,247,061 B2
(45) Date of Patent: Jul. 24, 2007

(54) CONNECTOR ASSEMBLY FOR CONDUCTORS OF A UTILITY POWER DISTRIBUTION SYSTEM

(75) Inventors: Vladimir Hoxha, Toronto (CA); Barry Johnson, Vaughan (CA)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/449,062

(22) Filed: Jun. 7, 2006

(65) Prior Publication Data

US 2007/0004289 A1 Jan. 4, 2007

(51) Int. Cl.
*H01R 11/01* (2006.01)

(52) U.S. Cl. ..... 439/783

(58) Field of Classification Search ..... 439/783, 439/863, 782, 790, 791
See application file for complete search history.

(56) References Cited

U.S. PATENT DOCUMENTS

| | | | | |
|---|---|---|---|---|
| 3,235,944 | A | 2/1966 | Broske et al. | |
| 3,329,928 | A | 7/1967 | Broske | |
| 3,588,791 | A | 6/1971 | Polidori | |
| 3,811,105 | A | 5/1974 | Gerhard | |
| 4,027,939 | A | 6/1977 | White | |
| 4,279,461 | A | 7/1981 | Bussen et al. | |
| 4,384,753 | A * | 5/1983 | Mixon, Jr. | 439/92 |
| 4,600,264 | A | 7/1986 | Counsel | |
| 4,863,403 | A | 9/1989 | Shannon | |
| 5,152,701 | A * | 10/1992 | Polidori | 439/791 |
| 5,774,987 | A | 7/1998 | Chadbourne et al. | |
| 5,830,019 | A | 11/1998 | Chadbourne et al. | |
| 5,862,589 | A | 1/1999 | Chadbourne et al. | |
| 6,004,165 | A * | 12/1999 | Dinh et al. | 439/783 |
| 6,045,414 | A * | 4/2000 | DeFrance | 439/794 |
| 6,120,334 | A | 9/2000 | Timsit et al. | |
| 6,390,861 | B1 * | 5/2002 | DeFrance | 439/783 |
| 6,517,391 | B1 | 2/2003 | Chadbourne | |
| 2002/0142674 | A1 * | 10/2002 | Chadbourne et al. | 439/783 |

* cited by examiner

*Primary Examiner*—Neil Abrams
*Assistant Examiner*—Phuongchi Nguyen

(57) ABSTRACT

An electrical connector assembly includes a first conductive member having a first hook portion and a first base portion, wherein the first hook portion extends from the first base portion, and a second conductive member having a second hook portion and a second base portion, wherein the second hook portion extends from the second base portion. A wedge member is nested between the first and second base portions, wherein the wedge member is movable in a loading direction. The wedge member drives the first and second base portions away from one another as the wedge member is moved in the loading direction. The first hook portion and the second base portion cooperate to securely engage a first conductor therebetween, and the second hook portion and the first base portion cooperate to securely engage a second conductor therebetween.

20 Claims, 6 Drawing Sheets

CONNECTOR ASSEMBLY FOR CONDUCTORS OF A UTILITY POWER DISTRIBUTION SYSTEM

BACKGROUND OF THE INVENTION

This invention relates generally to electrical connectors, and more particularly, to power utility connectors for mechanically and electrically connecting a tap or distribution conductor to a main electrical transmission conductor.

Electrical utility firms constructing, operating and maintaining overhead and/or underground power distribution networks and systems utilize connectors to tap main power transmission conductors and feed electrical power to distribution line conductors, sometimes referred to as tap conductors. The main power line conductors and the tap conductors are typically high voltage cables that are relatively large in diameter, and the main power line conductor may be differently sized from the tap conductor, requiring specially designed connector components to adequately connect tap conductors to main power line conductors. Generally speaking, three types of connectors are commonly used for such purposes, namely bolt-on connectors, compression-type connectors, and wedge connectors.

Bolt-on connectors typically employ die-cast metal connector pieces or connector halves formed as mirror images of one another, sometimes referred to as clam shell connectors. Each of the connector halves defines opposing channels that axially receive the main power conductor and the tap conductor, respectively, and the connector halves are bolted to one another to clamp the metal connector pieces to the conductors. Such bolt-on connectors have been widely accepted in the industry primarily due to their ease of installation, but such connectors are not without disadvantages. For example, proper installation of such connectors is often dependent upon predetermined torque requirements of the bolt connection to achieve adequate connectivity of the main and tap conductors. Applied torque in tightening the bolted connection generates tensile force in the bolt that, in turn, creates normal force on the conductors between the connector halves. Applicable torque requirements, however, may or may not be actually achieved in the field and even if the bolt is properly tightened to the proper torque requirements initially, over time, and because of relative movement of the conductors relative to the connector pieces or compressible deformation of the cables and/or the connector pieces over time, the effective clamping force may be considerably reduced. Additionally, the force produced in the bolt is dependent upon frictional forces in the threads of the bolt, which may vary considerably and lead to inconsistent application of force among different connectors.

Compression connectors, instead of utilizing separate connector pieces, may include a single metal piece connector that is bent or deformed around the main power conductor and the tap conductor to clamp them to one another. Such compression connectors are generally available at a lower cost than bolt-on connectors, but are more difficult to install. Hand tools are often utilized to bend the connector around the cables, and because the quality of the connection is dependent upon the relative strength and skill of the installer, widely varying quality of connections may result. Poorly installed or improperly installed compression connectors can present reliability issues in power distribution systems.

Wedge connectors are also known that include a C-shaped channel member that hooks over the main power conductor and the tap conductor, and a wedge member having channels in its opposing sides is driven through the C-shaped member, deflecting the ends of the C-shaped member and clamping the conductors between the channels in the wedge member and the ends of the C-shaped member. One such wedge connector is commercially available from Tyco Electronics Corporation of Harrisburg, Pa. and is known as an AMPACT Tap or Stirrup Connector. AMPACT connectors include different sized channel members to accommodate a set range of conductor sizes, and multiple wedge sizes for each channel member. Each wedge accommodates a different conductor size. As a result, AMPACT connectors tend to be more expensive than either bolt-on or compression connectors due to the increased part count. For example, a user may be required to possess three channel members that accommodate a full range of conductor sizes. Additionally, each channel member may require up to five wedge members to accommodate each conductor size for the corresponding channel member. As such, the user must carry fifteen connector pieces in the field to accommodate the full range of conductor sizes. The increased part count increases the overall expense and complexity of the AMPACT connectors.

AMPACT connectors are believed to provide superior performance over bolt-on and compression connectors. For example, the AMPACT connector results in a wiping contact surface that, unlike bolt-on and compression connectors, is stable, repeatable, and consistently applied to the conductors, and the quality of the mechanical and electrical connection is not as dependent on torque requirements and/or relative skill of the installer. Additionally, and unlike bolt-on or compression connectors, because of the deflection of the ends of the C-shaped member some elastic range is present wherein the ends of the C-shaped member may spring back and compensate for relative compressible deformation or movement of the conductors with respect to the wedge and/or the C-shaped member.

It would be desirable to provide a lower cost, more universally applicable alternative to conventional wedge connectors that provides superior connection performance to bolt-on and compression connectors.

BRIEF DESCRIPTION OF THE INVENTION

In one aspect, an electrical connector assembly is provided including a first conductive member having a first hook portion and a first base portion, wherein the first hook portion extends from the first base portion, and a second conductive member having a second hook portion and a second base portion, wherein the second hook portion extends from the second base portion. A wedge member is nested between the first and second base portions, wherein the wedge member is movable in a loading direction. The wedge member drives the first and second base portions away from one another as the wedge member is moved in the loading direction. The first hook portion and the second base portion cooperate to securely engage a first conductor therebetween, and the second hook portion and the first base portion cooperate to securely engage a second conductor therebetween.

Optionally, a first conductor channel may be formed between the first hook portion and the second base portion, and a second conductor channel may be formed between the second hook portion and the first base portion, wherein the wedge member reduces the size of the first and second conductor channels as the wedge member is moved in the loading direction. Each base portion may include a tapered wedge slot that receives the wedge member. Optionally, at least one of the first hook portion and the second base portion may be movable generally toward one another from an initial position to a final position. In the initial position, the first hook portion and the second base portion may be separated by a first distance, wherein the distance accommodates a range of conductor diameters of the first conductor. In the final position, the first hook portion and the second base portion are separated by a second distance that is smaller than the first distance, wherein the second distance being substantially equal to a diameter of the first conductor. Optionally, the wedge member may load the first and second hook portions with potential energy by elastically deforming the first and second hook portions against the first and second conductors.

In another aspect, an electrical connector assembly is provided including a first conductive member and a second conductive member separately fabricated from one another. Each of the first and second conductive members has a base portion and a deflectable hook portion extending from the base portion. The base portion and the hook portion of each conductive member form a channel, and the channel extends between a base end and a hook end. The base portion of the first conductive member is nested at the base end of the channel in the second conductive member and the base portion of the second conductive member is nested at the base end of the channel in the first conductive member. The hook portion of the first conductive member is adapted to receive a first conductor at the conductor end of the channel in the first conductive member, and the hook portion of the second conductive member is adapted to receive a second conductor at the conductor end of the channel in the second conductive member. A wedge member variably positionable between the base portions of the first and second conductive members for controlling the relative positions of the first and second conductive members.

DETAILED DESCRIPTION OF THE INVENTION

Figure 1:
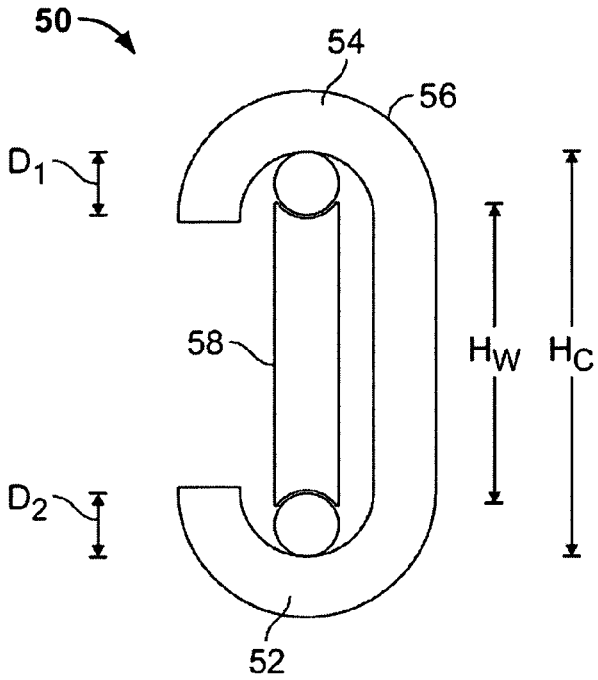
FIG. 1 (Prior Art)
FIG. 1 is a side elevational view of a known wedge connector assembly.
Figure 2:
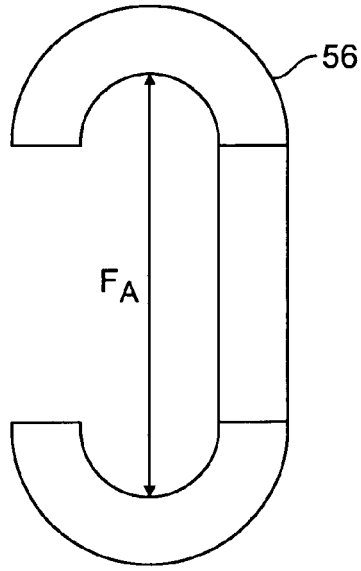
FIG. 2 (Prior Art)
FIG. 2 is a side elevational view of a portion of the assembly shown in FIG. 1.

FIGS. 1 and 2 illustrate a known wedge connector assembly 50 for power utility applications wherein mechanical and electrical connections between a tap or distribution conductor 52 and a main power conductor 54 are to be established. The connector assembly 50 includes a C-shaped spring member 56 and a wedge member 58. The spring member 56 hooks over the main power conductor 54 and the tap conductor 52, and the wedge member 58 is driven through the spring member 56 to clamp the conductors 52, 54 between the ends of the wedge member 58 and the ends of the spring member 56.

The wedge member 58 may be installed with special tooling having for example, gunpowder packed cartridges, and as the wedge member 58 is forced into the spring member 56, the ends of the spring member 56 are deflected outwardly and away from one another via the applied force $F_A$ shown in FIG. 2. Typically, the wedge member 58 is fully driven to a final position wherein the rear end of the wedge member 58 is aligned with the rear edge of the spring member 56. The rear edge of the spring member 56 acts as a stop for the tooling when driving the wedge member 58. Additionally, the amount of deflection of the ends of the spring member 56 is determined by the size of the conductors 52 and 54 and the dimension of the wedge 58. For example, the deflection is greater for the larger diameter conductors 52 and 54.

As shown in FIG. 1, the wedge member 58 has a height $H_W$, while the spring member 56 has a height $H_C$ between opposing ends of the spring member 56 where the conductors 52, 54 are received. The tap conductor 52 has a first diameter $D_1$ and the main conductor 54 has a second diameter $D_2$ that may be the same or different from $D_1$. As is evident from FIG. 1, $H_W$ and $H_C$ are selected to produce interference between each end of the spring member 56 and the respective conductor 52, 54. Specifically, the interference I is established by the relationship:

$$I=H_c-(D_1+D_2+H_w) \quad (1)$$

With strategic selection of $H_W$ and $H_C$ the actual interference I achieved may be varied for different diameters $D_1$ and $D_2$ of the conductors 52 and 54. Alternatively, $H_W$ and $H_C$ may be selected to produce a desired amount of interference I for various diameters $D_1$ and $D_2$ of the conductors 52 and 54. For example, for larger diameters $D_1$ and $D_2$ of the conductors 52 and 54, a smaller wedge member 58 having a reduced height $H_W$ may be selected. Alternatively, a larger spring member 56 having an increased height $H_C$ may be selected to accommodate the larger diameters $D_1$ and $D_2$ of the conductors 52 and 54. As a result, a user requires multiple sized wedge members 52 and/or spring members 56 in the field to accommodate a full range of diameters $D_1$ and $D_2$ of the conductors 52 and 54. Consistent generation of at least a minimum amount of interference I results in a consistent application of applied force $F_A$ which will now be explained in relation to FIG. 3.

Figure 3:
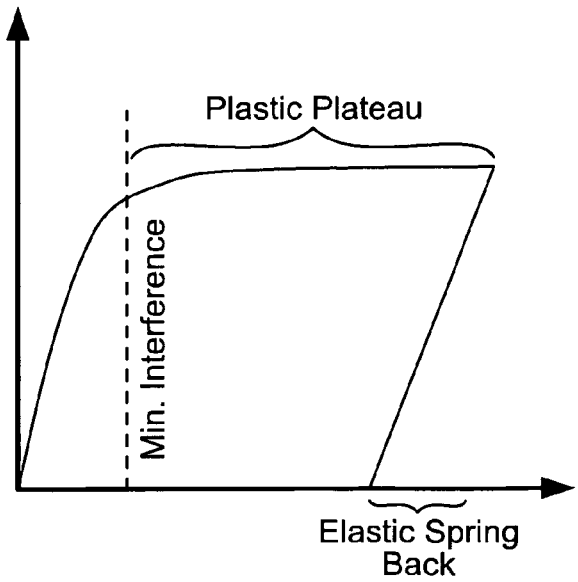
FIG. 3 is a force/displacement graph for the assembly shown in FIG. 1.

FIG. 3 illustrates an exemplary force versus displacement curve for the assembly 50 shown in FIG. 1. The vertical axis represents the applied force and the horizontal axis represents displacement of the ends of the spring member 56 as the wedge member 58 is driven into engagement with the conductors 52, 54 and the spring member 56. As FIG. 3 demonstrates, a minimum amount of interference, indicated in FIG. 3 with a vertical dashed line, results in plastic deformation of the spring member 56 that, in turn, provides a consistent clamping force on the conductors 52 and 54, indicated by the plastic plateau in FIG. 3. The plastic and elastic behavior of the spring member 56 is believed to provide repeatability in clamping force on the conductors 52 and 54 that is not possible with known bolt-on connectors or compression connectors. A need for an inventory of differently sized spring members 56 and wedge members 58 renders the connector assembly 50 more expensive and less convenient than some user's desire.

Figure 4:
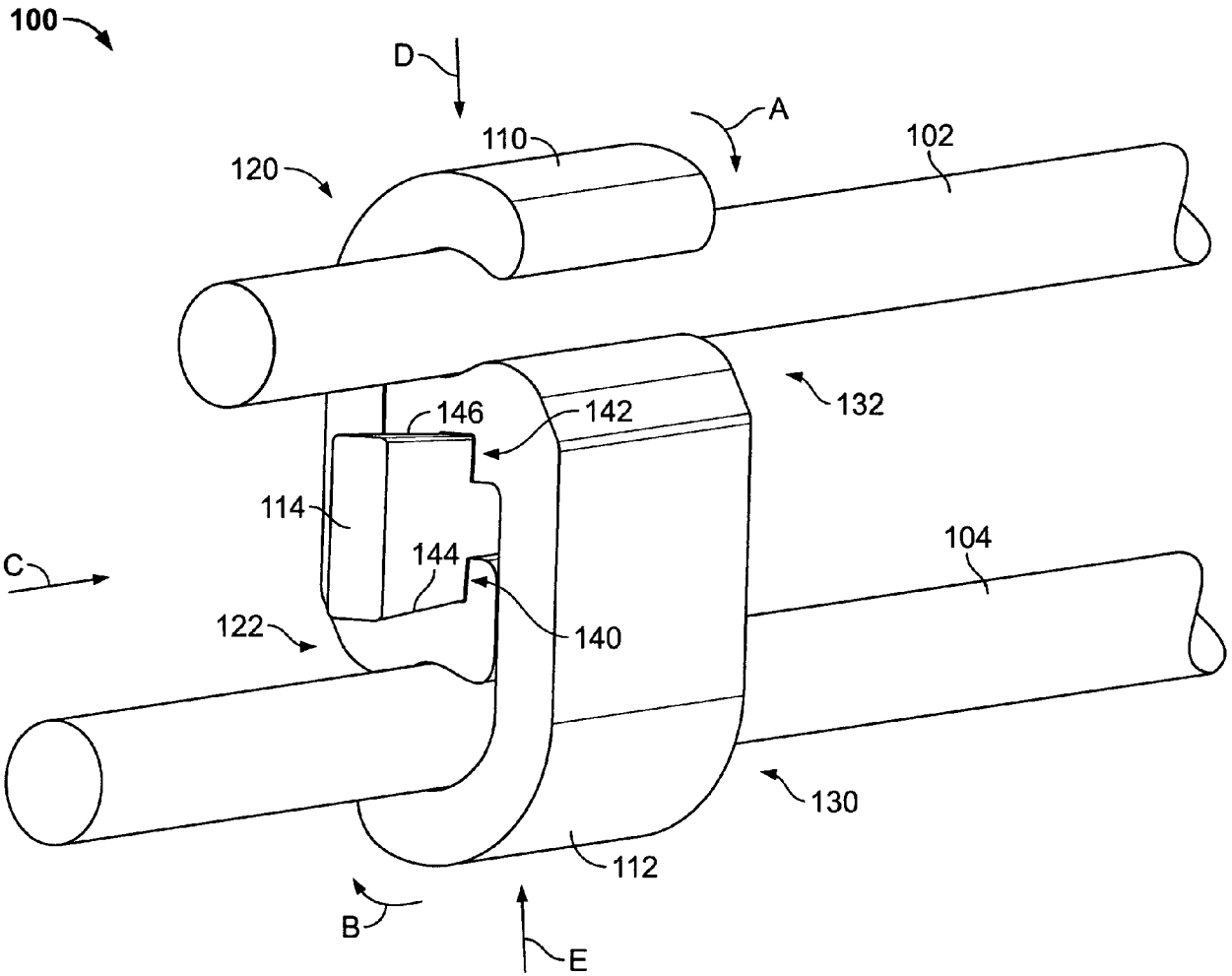
FIG. 4 is a perspective view of a connector assembly in a mated position and formed in accordance with an exemplary embodiment of the present invention.
Figure 5:
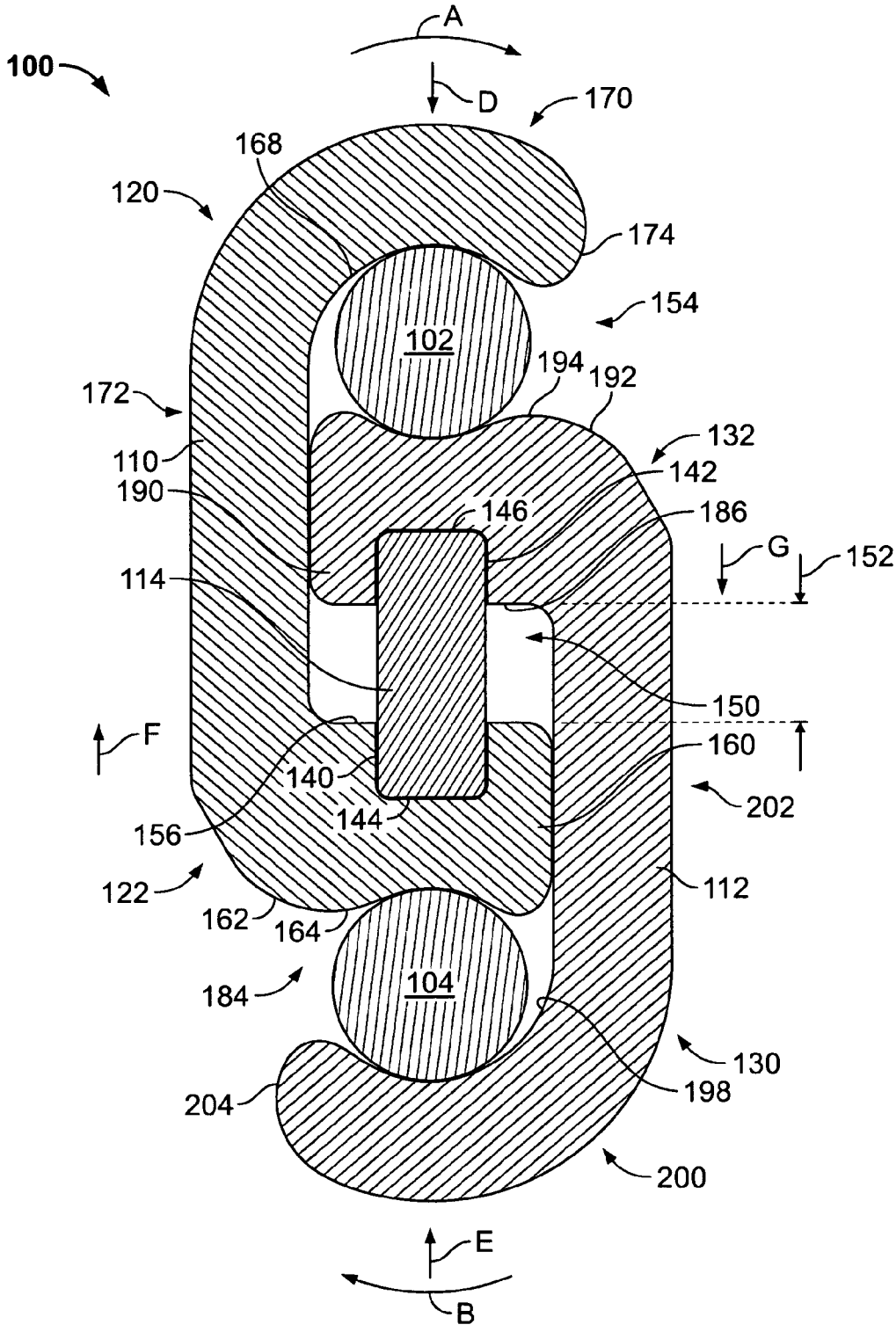
FIG. 5 is a cross-sectional view of the connector assembly shown in FIG. 4.

A connector assembly 100 is provided that overcomes these and other disadvantages. The connector assembly 100 is described with reference to FIGS. 4-5. FIG. 4 is a perspective view of the connector assembly 100 in a mated position and formed in accordance with an exemplary embodiment of the present invention; and FIG. 5 is a cross-sectional view of the connector assembly 100 in a mated position. The connector assembly 100 is adapted for use as a tap connector for connecting a tap conductor 104 to a main conductor 102 of a utility power distribution system. As explained in detail below, the connector assembly 100 provides superior performance and reliability to known bolt-on and compression connectors, while providing ease of installation and greater range taking capability to known wedge connector systems.

The tap conductor 104, sometimes referred to as a distribution conductor, may be a known high voltage cable or line having a generally cylindrical form in an exemplary embodiment. The main conductor 102 may also be a generally cylindrical high voltage cable line. The tap conductor 104 and the main conductor 102 may be of the same wire gauge or different wire gauge in different applications and the connector assembly 100 is adapted to accommodate a range of wire gauges for each of the tap conductor 104 and the main conductor 102.

When installed to the tap conductor 104 and the main conductor 102, the connector assembly 100 provides electrical connectivity between the main conductor 102 and the tap conductor 104 to feed electrical power from the main conductor 102 to the tap conductor 104 in, for example, an electrical utility power distribution system. The power distribution system may include a number of main conductors 102 of the same or different wire gauge, and a number of tap conductors 104 of the same or different wire gauge. The connector assembly 100 may be used to provide tap connections between main conductors 102 and tap conductors 104 in the manner explained below.

As shown in FIG. 4, the connector assembly 100 includes a first or main conductive member 110, a second or tap conductive member 112, and a wedge member 114 nested therebetween. Both of the conductive members 110, 112 cooperate to retain both of the conductors 102, 104, as will be explained in further detail below. Optionally, the first and second conductive members 110 and 112 are substantially identically formed and have substantially identical dimensions.

The first conductive member 110 includes a first hook portion 120 and a first base portion 122. The portions 120 and 122 form a C-shape or J-shape with the first hook portion 120 extending from the first base portion 122 and receiving the main conductor 102. The second conductive member 112 includes a second hook portion 130 and a second base portion 132. The portions 130 and 132 form a C-shape or J-shape with the second hook portion 130 extending from the second base portion 132 and receiving the tap conductor 104. Optionally, the first hook portion 120 is adapted to extend around the main conductor 102 in a first direction, shown generally by an arrow A, and the second hook portion 130 is adapted to extend around the tap conductor 104 in a second direction, shown generally by an arrow B. The second direction is generally opposite to the first direction. In an exemplary embodiment, the first hook portion 120 and the second base portion 132 cooperate to secure the main conductor 102 therebetween. Similarly, the second hook portion 130 and the first base portion 122 cooperate to secure the tap conductor 104 therebetween. Optionally, the first hook portion 120 and the second base portion 132 are movable toward one another for pinching the main conductor 102 therebetween, and the second hook portion 130 and the first base portion 122 are movable toward one another for pinching the tap conductor 104 therebetween.

The wedge member 114 is nested between the first and second base portions 122, 132. The wedge member 114 is received in a first slot 140 in the first base portion 122 and a second slot 142 in the second base portion 132. Optionally, the wedge member 114 may include tapered or angled sides 144 and 146 that engage the bottoms of the slots 140, 142, which may also be tapered. The wedge member 114 is movable in a loading direction, shown generally by an arrow C, from an initial position to a final position. Optionally, the loading direction may be substantially parallel to each of the main and tap conductors 102, 104. In operation, the wedge member 114 drives the first and second conductive members 110, 112 from an initial, unmated position, such as the position shown in FIG. 7, wherein the conductors 102, 104 are unsecured by the conductive members 110, 112 to the final mated position, such as the position shown in FIG. 4, wherein the conductors 102, 104 are secured between the conductive members 110, 112. In the final position, the wedge member 114 loads the first and second hook portions 120, 130 with potential energy by elastically and/or plastically deforming the hook portions 120, 130 against the main and tap conductors 102, 104. Optionally, when the connector assembly 100 is in the mated position, at least a portion of the conductors 102, 104 are exposed to the environment by a gap between the hook portions 120, 130 and the base portions 122, 132.

In operation, the wedge member 114 drives the first and second base portions 122, 132 away from one another as the wedge member 114 is moved in the loading direction. Optionally, the wedge member 114 drives the first hook portion 120 and the first base portion 122 in a first direction, shown generally by an arrow D, and the wedge member 114 simultaneously drives the second hook portion 130 and the second base portion 132 in a second direction, shown generally by an arrow E. The first hook portion 120 is moved generally toward the main conductor 102 as it moves in the first direction. The first base portion 122 is moved generally toward the tap conductor 104 as it moves in the first direction. The second hook portion 130 is moved generally toward the tap conductor 104 as it moves in the second direction. The second base portion 132 is moved generally toward the main conductor 102 as it moves in the second direction. Once the conductive members 110, 112 fully engage the conductors 102, 104, the hook portions 120, 130 are deflected and rotated generally outward as the base members 122, 132 continue to move outward.

In an intermediate position between the initial position and the final position, the conductive members 110, 112 snuggly hold the conductors 102, 104 between the hook portions 120, 130 and the base portions 122, 132. The conductive members 110, 112 are driven to the intermediate position by the wedge member 114. In the intermediate position, both of the first hook portion 120 and the second base portion 132 engage the main conductor 102. Immediately prior to being in the intermediate position, at least one of the first hook portion 120 and/or the second base portion 132 does not engage the main conductor 102. Immediately after being in the intermediate position, the first hook portion 120 begins to deflect and is deflected further as the wedge member 114 is driven to the final position. Optionally, the first hook portion 120 undergoes both elastic and plastic deflection and deformation as the wedge member 114 is driven to the final position, and at least a minimum amount of interference I is generated between the conductive members 110, 112 and the main conductor 102. Similarly, in the intermediate position, both of the second hook portion 130 and the first base portion 122 engage the tap conductor 104. Immediately prior to being in the intermediate position, at least one of the second hook portion 130 and/or the first base portion 122 does not engage the tap conductor 104. Immediately after being in the intermediate position, the second hook portion 130 begins to deflect and is deflected further as the wedge member 114 is driven to the final position. Optionally, the second hook portion 130 undergoes both elastic and plastic deflection and deformation as the wedge member 114 is driven to the final position, and at least a minimum amount of interference I is generated between the conductive members 110, 112 and the tap conductor 104.

Turning to FIG. 5, the connector assembly 100 is shown in the mated position, wherein the conductors 102, 104 are pinched between the first and second conductive members 110, 112. Additionally, the wedge member 114 is illustrated driven to the final position, such that a gap 150 is created between the first and second base portions 122, 132. The gap 150 has a height 152 that is selected to provide an applied force $F_A$ between the conductors 102, 104 and the conductive members 110, 112. As indicated above, the height 152 of the gap 150 is increased as the wedge member 114 is driven to the final position. Optionally, the height 152 of the gap 150 may be approximately zero in the initial position. When the wedge member 114 is received within the slots 140, 142, the wedge member 114 is completely surrounded by the conductive members 110, 112. Optionally, the first side 144 of the wedge member 114 engages the first base portion 122 and the second side 146 of the wedge member 114 engages the second base portion 132. The wedge member 114 is spaced apart from the conductors 102, 104 and is separated therefrom by the conductive members 110, 112. As such, the wedge member 114 does not contact either of the conductors 102, 104.

The hook portion 120 and the base portion 122 of the first conductive member 110 together define a first channel 154 having a first clearance. The first channel 154 is open on one side, and surrounded on the remaining sides by the hook and base portions 120, 122. In an exemplary embodiment, the first channel 154 receives the main conductor 102 and the base portion 132 of the second conductive member 112 therein. The base portion 122 of the first conductive member 110 includes a flat inner surface 156 that faces the first channel 154. Optionally, the first slot 140 may open to the flat inner surface 156, and may be positioned remote from a distal end 160 of the base section 122. Optionally, the first slot 140 may be generally tapered from one end to the other end to accommodate and uniformly engage the wedge member 114 as the wedge member 114 is driven into the first slot 140. An outer surface 162 of the base section 122 includes an inwardly curved or concave conductor engagement surface 164. The conductor engagement surface 164 engages the tap conductor 104 in the final assembled position. The engagement surface 164 is radiused to uniformly engage and capture the tap conductor 104. The radius of the engagement surface 164 is selected to accommodate a range of conductor diameters. Optionally, both the inner surface 156 and the outer surface 162 may extend generally parallel to one another.

The hook portion 120 extends from the base portion 122 and includes a curved inner surface 168 generally opposite the flat inner surface 156 of the base portion 122. The hook portion 120 includes a curved section 170 and a joining section 172 extending between the curved section 170 and the base portion 122. The curved section 170 includes the inner surface 168 and forms a cradle that receives the main conductor 102 at a spaced relation from the base portion 122. A distal end 174 of the curved section 172 includes a radial bend that wraps around the main conductor 102 for about 180 circumferential degrees in an exemplary embodiment, such that the distal end 174 faces toward the base portion 122. The radius of the inner surface 168 is selected to accommodate a range of conductor diameters. The joining section 172 extends perpendicularly from the base section 122, and the height of the joining section 172 determines a size of the first channel 154 and a diameter, or range of diameters, of the main conductor 102 received within the curved section 170 of the hook portion 120. The hook portion 120 and the base portion 122 together resemble the shape of a C or a J. The first conductive member 110 may be integrally formed and fabricated from extruded metal, together with the hook and base portions 120, 122 in a relatively straightforward and low cost manner.

The hook portion 130 and the base portion 132 of the second conductive member 112 together define a second channel 184 having a second clearance. The second channel 184 is open on one side, and surrounded on the remaining sides by the hook and base portions 130, 132. In an exemplary embodiment, the second channel 184 receives the tap conductor 104 and the base portion 122 of the first conductive member 110 therein. The base portion 132 of the second conductive member 120 includes a flat inner surface 186 that faces the first channel 184. Optionally, the second slot 142 may open to the flat inner surface 186, and may be positioned remote from a distal end 190 of the base section 132. Optionally, the second slot 142 may be generally tapered from one end to the other end to accommodate and uniformly engage the wedge member 114 as the wedge member 114 is driven into the second slot 142. An outer surface 192 of the base section 132 includes an inwardly curved or concave conductor engagement surface 194. The conductor engagement surface 194 engages the main conductor 102 in the final assembled position. The engagement surface 194 is radiused to uniformly engage and capture the main conductor 102. The radius of the engagement surface 194 is selected to accommodate a range of conductor diameters. Optionally, both the inner surface 186 and the outer surface 192 may extend generally parallel to one another. The inner surface 186 and the outer surface 192 may also be parallel to the inner surface 156 and the outer surface 162 of the first conductive member 110. Optionally, the conductive members 110, 112 may cooperate to hold the conductors 102, 104 in a parallel orientation with respect to one another.

The hook portion 130 extends from the base portion 132 and includes a curved inner surface 198 generally opposite the flat inner surface 186 of the base portion 132. The hook portion 130 includes a curved section 200 and a joining section 202 extending between the curved section 200 and the base portion 132. The curved section 200 includes the inner surface 198 and forms a cradle that receives the tap conductor 104 at a spaced relation from the base portion 132. A distal end 204 of the curved section 202 includes a radial bend that wraps around the tap conductor 104 for about 180 circumferential degrees in an exemplary embodiment, such that the distal end 204 faces toward the base portion 132. The radius of the inner surface 198 is selected to accommodate a range of conductor diameters. The joining section 202 extends perpendicularly from the base section 132, and the height of the joining section 202 determines a size of the second channel 184 and a diameter, or range of diameters, of the tap conductor 104 received within the curved section 200 of the hook portion 130. The hook portion 130 and the base portion 132 together resemble the shape of a C or a J. The second conductive member 112 may be integrally formed and fabricated from extruded metal, together with the hook and base portions 130, 132 in a relatively straightforward and low cost manner.

The first conductive member 110 and the second conductive member 112 are separately fabricated from one another or otherwise formed into discrete connector components and are assembled to one another as explained below. While one exemplary shape of the first and second conductive members 110, 112 has been described herein, it is recognized that the conductive members 110, 112 may be alternatively shaped in other embodiments as desired.

In one embodiment, the hook portions 120, 130 and/or the base portions 122 and 124 of the respective first and second conductive members 110, 112 are substantially identically formed and share the same geometric profile and dimensions to facilitate interfitting and mating of the conductive members 110, 112 in the manner explained below. The hook portions 120, 130 and/or base portions 122, 132 of the conductive members 110, 112, however, may be differently dimensioned as appropriate to be engaged to differently sized conductors 102, 104 while maintaining substantially the same shape of the conductive members 110, 112. Formation of conductive members 110, 112 having different sizes provides for mixing and matching of conductive members 110, 112 for differently sized conductors 102, 104 while achieving a repeatable and reliable assembly. Additionally, providing conductive members 110, 112 that accommodate a range of conductor diameters facilitates reducing an overall part number and part count for the overall power distribution assembly system.

As shown in FIG. 5, the first conductive member 110 and the second conductive member 112 are generally inverted relative to one another with the respective base portions 122 and 132 facing one another and received within the other conductive members' 110, 112 channel 154 or 184. The hook portion 120 of the first conductive member 110 extends away from the base portion 122 in a first direction, indicated by the arrow F, and the hook portion 132 of the second conductive member 112 extends from the base portion 132 in a second direction, indicated by arrow G that is opposite to the direction of arrow F. Additionally, the hook portion 120 of the first conductive member 110 extends around the main conductor 102 in a circumferential direction indicated by the arrow A, while the hook portion 130 of the second conductive member 112 extends circumferentially around the tap conductor 104 in the direction of arrow B that is opposite to arrow A.

Figure 6:
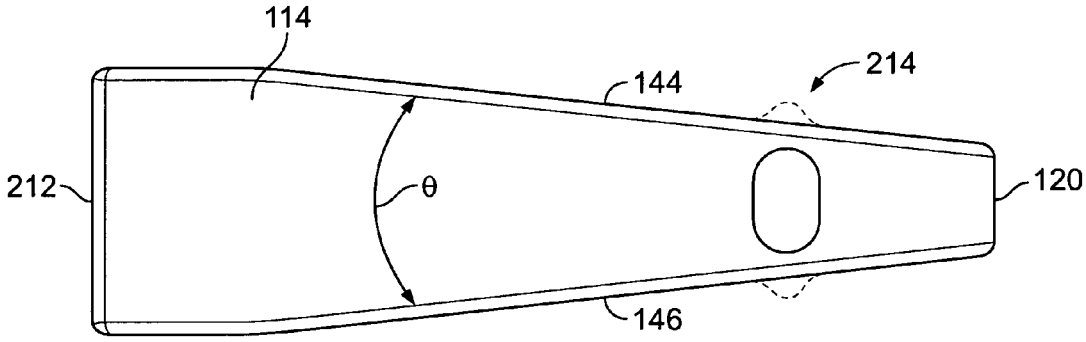
FIG. 6 is a top view of a wedge member for the connector assembly shown in FIG. 4 and formed in accordance with an exemplary embodiment of the present invention.

FIG. 6 is a top view of the wedge member 114 formed in accordance with an exemplary embodiment of the present invention. The wedge member 114 includes a front end 210, a rear end 212 and sides 144 and 146 extending therebetween. The front end 210 is the end that is initially received within the slots 140, 142 of the conductive members 110, 112 (shown in FIGS. 4 and 5). The rear end 212 extends parallel to, and is spaced apart from, the front end 210. The sides 144, 146 are tapered for at least a portion of their lengths between the front and rear ends 210, 212. The sides 144, 146 are tapered at an angle θ. Optionally, each side 144, 146 may be tapered at the same angle (e.g. ½θ). Alternatively, the sides 144, 146 may be tapered at different angles, or only one side 144 or 146 may be tapered. Optionally, the wedge member 114 may include a locking feature 214 that may function as a safety lock and/or a visual indication to the user that the wedge member 114 has been properly inserted. In the illustrated embodiment, the locking feature 214 includes an opening that is equally spaced apart from the sides 144, 146. During use, the wedge member 114 is pressed or swaged, and the locking feature 214 is compressed. The compression causes the sides 140, 142 to buckle or bend outward at the locking feature 114, shown in phantom in FIG. 6. The increase in size of the wedge member 114 at that portion resists removal of the wedge member 114 from the conductive members 110, 112.

Figure 7:
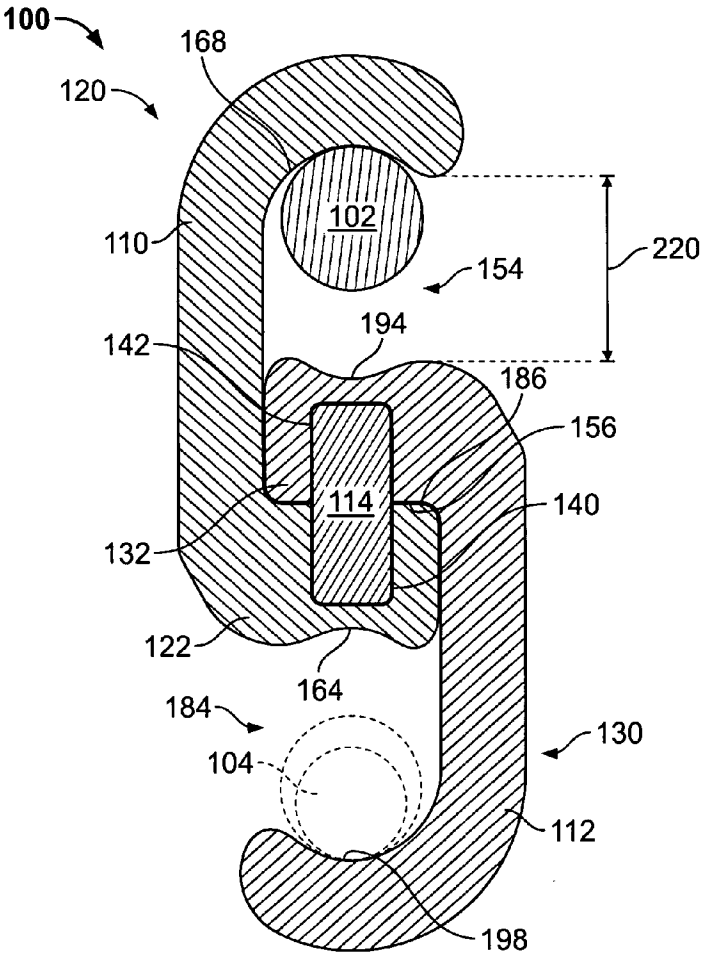
FIG. 7 is a cross-sectional view of the connector assembly shown in FIG. 4 in an unmated position.

FIG. 7 is a cross-sectional view of the connector assembly 100 in an unmated position. In the unmated position, the base portions 122, 132 are positioned within the channels 154, 184 of the opposite conductive member 110, 112. The conductors 102, 104 are also received within the channels 154, 184 of the respective conductive members 110, 112. The wedge member 114 is then received within the slots 140, 142. Optionally, the base portions 122, 132 may be positioned first, the conductors 102, 104 positioned second, and the wedge member 114 positioned third. Alternatively, the conductors 102, 104 may be positioned first, the base portions 122, 132 positioned second, and the wedge member 114 third. Alternatively, the base portions 122, 132 may be positioned first, the wedge member 114 positioned second, and the conductors 102, 104 positioned third. Optionally, when the base portions 122, 132 are initially assembled within the channels 154, 184, the flat inner surfaces 156, 186 abut one another, such that a maximum distance separates the conductor engagement surfaces 164, 194 and the curved inner surfaces 168, 198 of the hook portions 120, 130. As such, the largest possible conductor size may be accommodated by the connector assembly 100. However, smaller conductor sizes may also be accommodated by the connector assembly 100. For example, various conductor sizes for the main conductor are illustrated in FIG. 7 in phantom.

In the illustrated embodiment, the conductor engagement surface 194 and the curved inner surface 168 are separated by a distance 220. The distance 220 defines a window corresponding to a maximum conductor diameter that the connector assembly 100 may accommodate. The window is reduced during assembly as the wedge member 114 is moved from the initial position to the final position. Optionally, due to the curvature of the inner surface 168 and the curvature of the engagement surface 164, the window is smaller than the diameter of the conductor 102, thus trapping the conductor 102 within the cradle of the channel 154. Optionally, the conductor engagement surface 164 and the curved inner surface 168 are still separated by a distance when the connector assembly 100 is in the final position, such that the conductor 102 is visible through the window. By maintaining the window in the final position, all of the applied force is ensured to be transferred to the hook portion 120 indirectly via the conductor 102, rather than directly from the base portion 132 to the hook portion 120.

During assembly, the base portions 122, 132 are positioned within the channels 154, 184 of the opposite conductive member 110, 112. The conductors 102, 104 are also received within the channels 154, 184 of the respective conductive members 110, 112. The wedge member 114 is then received within the slots 140, 142. Once the conductors 102, 104 are positioned within the cradles of the hook portions 120, 130, the wedge member 114 is driven from the initial position to the intermediate position, and then to the final position. Optionally, the wedge member 114 may be driven in a two step process. For example, the wedge member 114 may be driven by hand, and without the use of a tool, by a user to the intermediate position, and then the wedge member 114 may be driven by a tool from the intermediate position to the final position. Alternatively, the wedge member 114 may be driven from the initial position to the final position in a one step process with the use of a tool.

Figure 8:
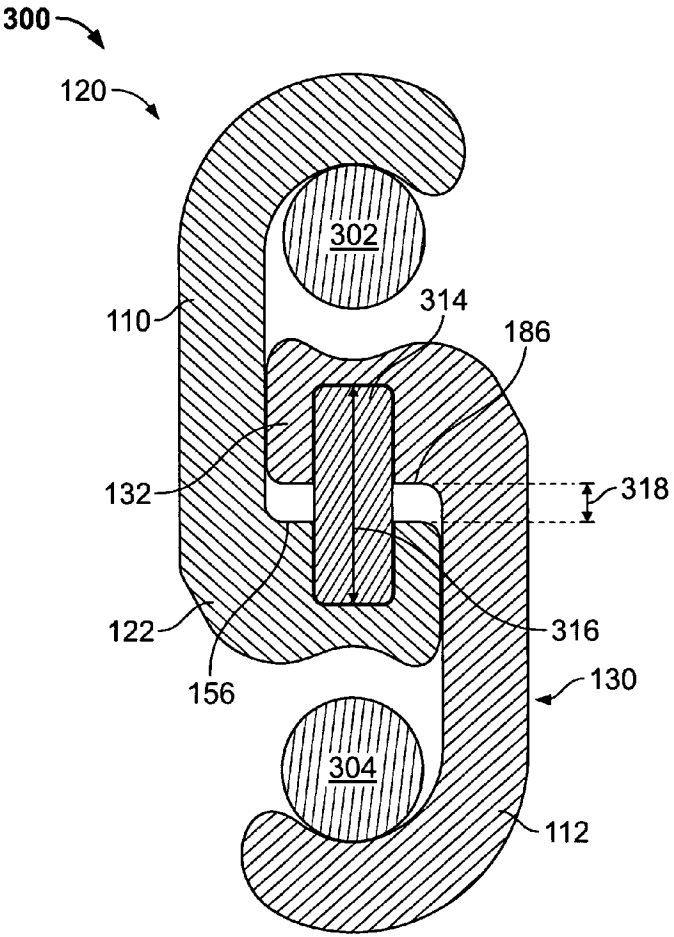
FIG. 8 is a cross-sectional view of another connector assembly formed in accordance with an alternative embodiment of the present invention.

FIG. 8 is a cross-sectional view of another connector assembly 300 formed in accordance with an alternative embodiment of the present invention. The connector assembly 300 is illustrated in the initial position. The connector assembly 300 is similar to the connector assembly 100 illustrated above, and as such, like reference numerals are used for like components. The connector assembly includes the first and second conductive members 110, 112. A difference over the connector assembly 100 is that the connector assembly 300 includes a wedge member 314 that has a different size, shape and/or geometry as the wedge member 114 of the connector assembly 100. The wedge member 314 has a greater height 316 as compared to a height of the wedge member 114. As such, in the initial position, the wedge member 314 positions the flat inner surfaces 156, 186 of the base portions 122, 132 away from one another. In the initial position, the base portions 122, 132 are separated by a distance 318.

In comparison to the connector assembly 100, the connector assembly 300 accommodates main and tap conductors 302 and 304 having smaller diameters. One reason to use multiple sized wedge members 114 and 314 within a connector system is to accommodate different ranges of conductor sizes. For example, one factor that limits a range of accommodation of conductor sizes is a length of the wedge member 114 or 314. The amount of applied force $F_A$ may be determined, at least in part, to the amount of deflection of the hook portions 120, 130. The amount of deflection, or vertical movement of the conductive members 110, 112, may be directly related to the horizontal travel distance of the wedge member 114, 314. The wedge member 114, 314 must be inserted a predetermined distance to move to the intermediate position, and then another predetermined amount to move to the final position. When using smaller diameter conductors, the amount of movement to the intermediate position is increased, leaving less length of the wedge member 114, 314 for moving to the final position. As such, by increasing the height 318 of the wedge member 314, the wedge member 314 is not inserted into the conductive members 110, 112 as far as the wedge member 114 for the same size conductors 102, 104. As such, the use of the wedge member 314 accommodates a different range of conductors. Optionally, the range of accommodation of the wedge member 314 may overlap with part of the range of accommodation of the wedge member 114. In an alternative embodiment, as alluded to above, rather than having an increased height, the wedge member 314 may have an increased length to accommodate a larger range of conductor sizes, and the connector system uses a single wedge member, thus reducing the part count.

Figure 9:
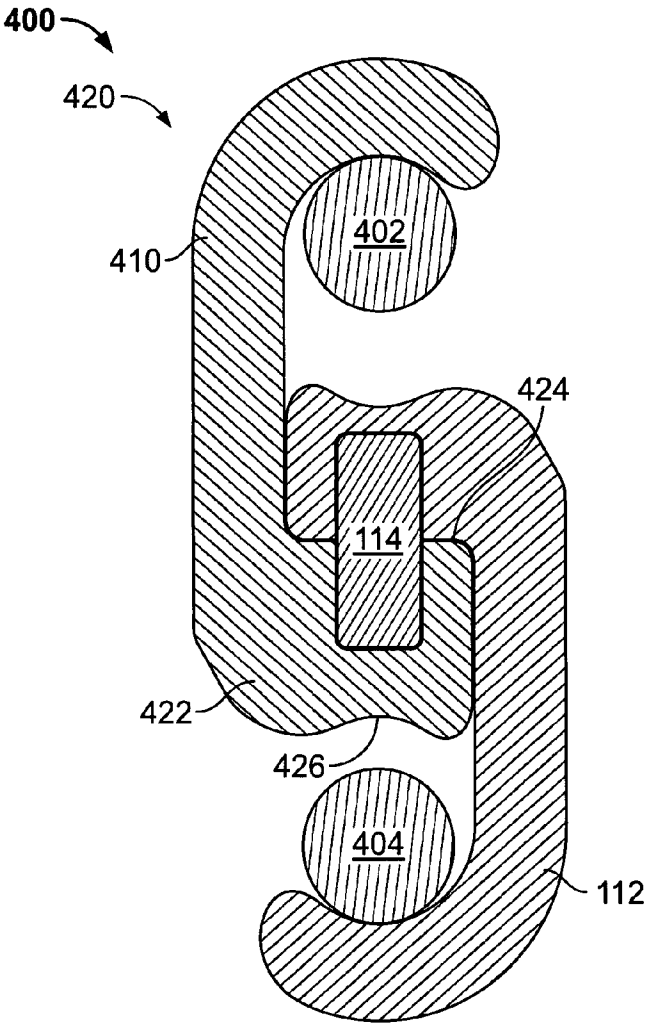
FIG. 9 is a cross-sectional view of yet another connector assembly formed in accordance with another alternative embodiment of the present invention.

FIG. 9 is a cross-sectional view of yet another connector assembly 400 formed in accordance with another alternative embodiment of the present invention. The connector assembly 400 is illustrated in the initial position. The connector assembly 400 is similar to the connector assembly 100 illustrated above, and as such, like reference numerals are used for like components. The connector assembly 400 includes a first conductive member 410 that has a similar shape as the conductive member 110 (shown in FIGS. 4-5, and 7), however, the conductive member 410 has different dimensions and/or geometry as the conductive member 110. The connector assembly 400 includes the second conductive member 112 and the wedge member 114 that are illustrated and described above.

The conductive member 410 includes a hook portion 420 and a base portion 422. Optionally, the hook portion 420 may be sized, shaped and dimensioned substantially similar to the hook portion 120 of the conductive member 110. Alternatively, the hook portion 420 may be sized, shaped and dimensioned differently than the hook portion 120 of the conductive member 110. In the illustrated embodiment, the base portion 422 is sized, shaped, and or dimensioned differently than the base portion 122. For example, the base portion 422 is thicker than the base portion 122 between a flat inner surface 424 and a conductor engagement surface 426. As a result, in the initial position, when the base portions 422 and 132 engage one another, the conductor engagement surface 426 is positioned relatively closer to a conductor 404 than would the conductor engagement surface 164 (shown in FIG. 5) of the conductive member 110. As a result, the conductive member 410 accommodates a range of conductors having smaller diameters as compared to the conductive member 110. Optionally, because the conductive member 410 accommodates a range of conductors having smaller diameters, the radius of the conductor engagement surface 426 may be different than the radius of the conductor engagement surface 164 of the conductive member 110. Optionally, the range of accommodation of the conductive member 410 may overlap with part of the range of accommodation of the conductive member 110.

Figure 10:
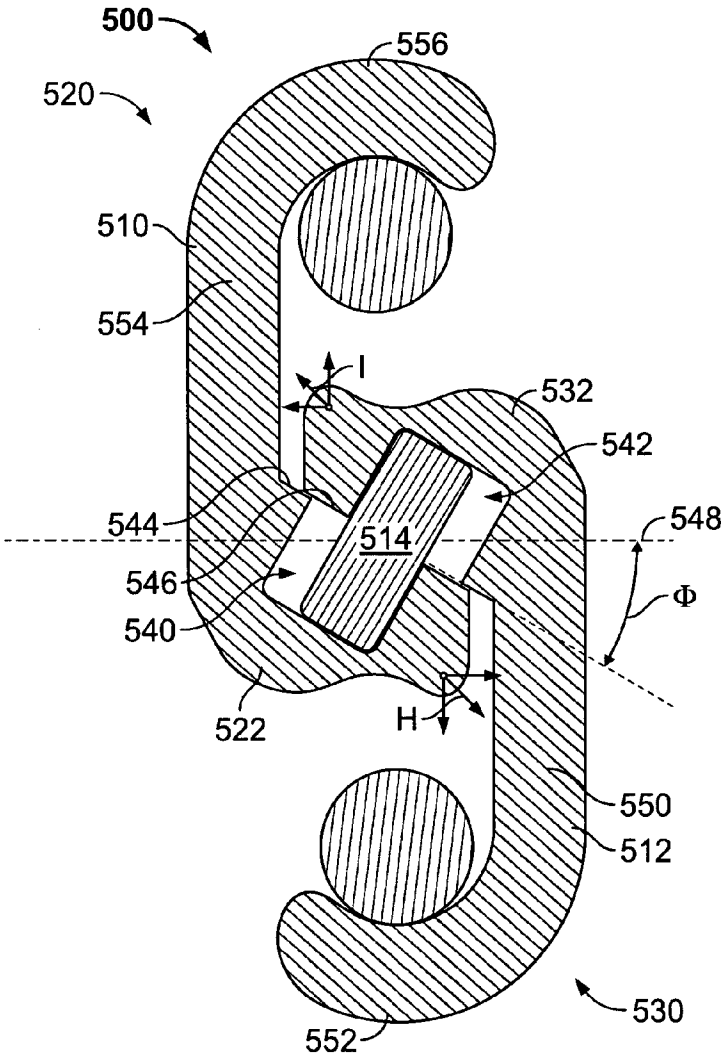
FIG. 10 is a cross-sectional view of a further connector assembly formed in accordance with another alternative embodiment of the present invention.

FIG. 10 is a cross-sectional view of a further connector assembly 500 formed in accordance with another alternative embodiment of the present invention. The connector assembly 500 is illustrated in the initial position. The connector assembly 500 is similar to the connector assembly 100 illustrated above, and as such, like reference numerals are used for like components. The connector assembly includes first and second conductive members 510, 512, and a wedge member 514 nested therebetween. The first conductive member 510 includes a hook portion 520 and a base portion 522 and the second conductive member 512 includes a hook portion 530 and a base portion 532. Each of the base portions 522, 532 include slots 540, 542 that receive the wedge member 514.

A difference over the connector assembly 100 is that the base members 522, 532 each include flat inner surfaces 544, 546 that are skewed or angled with respect to a central axis 548 of the connector assembly 500. The inner surfaces 544, 546 are skewed at an angle Φ. The slots 540, 542 extend perpendicularly inward from the flat inner surfaces 544, 546 such that the slots 540, 542 are also skewed or angled with respect to the central axis 548.

During assembly, as the wedge member 514 is loaded to the final position, the conductive members 510, 512 are moved at angles that are transverse to the central axis 548, shown generally by respective arrows H and I. Specifically, each conductive member 510, 512 is moved both horizontally, in a direction parallel to the central axis 548, and vertically, in a direction perpendicular to the central axis 548. The horizontal and vertical components are illustrated along with the arrows H and I. Optionally, to accommodate the horizontal movement, the slots 540, 542 may be wider than the thickness of the wedge member 514. As such, the conductive members 510, 512 may move generally toward the wedge member 514 as the wedge member 514 is loaded into the slots 540, 542. In general, as the wedge member 514 is loaded, the base portion 522 is moved generally in the direction of an intersection of a joining section 550 and a curved section 552 of the hook portion 530. Similarly, as the wedge member 514 is loaded, the base portion 532 is moved generally in the direction of an intersection of a joining section 554 and a curved section 556 of the hook portion 520.

As such, a connector assembly is provided that includes two conductive members and a wedge member nested therebetween. The wedge member is movable in a loading direction, wherein the wedge member drives the first and second base portions away from one another as the wedge member is moved in the loading direction. A hook portion of the first conductive member and a base portion of the second conductive member cooperate to securely engage a tap conductor therebetween, and a hook portion of the second conductive member and a base portion of the first conductive member cooperate to securely engage a second conductor therebetween. The size, shape and geometries of the conductive members and the wedge members may be selected to accommodate a range of conductor sizes. Additionally, by strategically selecting such sizes, shapes and geometries, repeatable and reliable performance of the connector assembly may be provided via elastic and plastic deformation of the hook portions, while eliminating a need for special tooling to assemble the connector assembly.

Additionally, even if several versions of the conductive members or wedge member are provided for installation to different conductor wire sizes or gages, the connector assembly requires a smaller inventory of parts in comparison to conventional wedge connector systems, for example, to accommodate a full range of installations in the field. That is, a relatively small family of connector parts having similarly sized and shaped wedge portions may effectively replace a much larger family of parts known to conventional wedge connector systems.

It is therefore believed that the connector assembly provides the performance of conventional wedge connector systems in a lower cost connector assembly that does not require specialized tooling and a large inventory of parts to meet installation needs. Using low cost extrusion fabrication processes and known fasteners, the connector assembly may be provided at low cost, while providing increased repeatability and reliability as the connector assembly is installed and used. The wedge action of the wedge member between the conductive members provides a reliable and consistent clamping force on the conductors and is less subject to variability of clamping force when installed than either of known bolt-on or compression-type connector systems.

While the invention has been described in terms of various specific embodiments, those skilled in the art will recognize that the invention can be practiced with modification within the spirit and scope of the claims.

What is claimed is:

1. An electrical connector assembly comprising:

a first conductive member comprising a first hook portion and a first base portion, the first hook portion extending from the first base portion;

a second conductive member comprising a second hook portion and a second base portion, the second hook portion extending from the second base portion; and a wedge member nested between the first and second base portions, the wedge member movable in a loading direction, wherein the wedge member drives the first and second base portions away from one another as the wedge member is moved in the loading direction;

wherein the first hook portion and the second base portion both engage and cooperate to secure a first conductor therebetween, and wherein the second hook portion and the first base portion both engage and cooperate to secure a second conductor therebetween.

2. The connector of claim 1, wherein a first conductor channel is formed between the first hook portion and the second base portion, and wherein a second conductor channel is formed between the second hook portion and the first base portion, the wedge member reducing the size of the first and second conductor channels as the wedge member is moved in the loading direction.

3. The connector of claim 1, wherein the wedge member is spaced apart from each of the first and second conductors.

4. The connector of claim 1, wherein the wedge member is surrounded by the first and second base portions.

5. The connector of claim 1, each base portion including a tapered wedge slot, the wedge member being received within the tapered wedge slots.

6. The connector of claim 1, wherein at least one of the first hook portion and the second base portion is movable generally toward one another from an initial position to a final position, in the initial position, the first hook portion and the second base portion are separated by a first distance, wherein the distance accommodates a range of conductor diameters of the first conductor, in the final position, the first hook portion and the second base portion are separated by a second distance that is smaller than the first distance, the second distance being substantially equal to a diameter of the first conductor.

7. The connector of claim 1, wherein as the wedge member is moved in the loading direction, the first and second hook portions are moved in directions generally toward the wedge member and the first and second base portions are moved in directions generally away from the wedge member.

8. The connector of claim 1, wherein the first base portion includes a radiused conductor contact surface engaging the second conductor, and wherein the second base portion includes a radiused conductor contact surface engaging the first conductor.

9. The connector of claim 1, wherein the first hook portion and the second base portion engage opposite sides of the first conductor, and wherein the second hook portion and the first base portion engage opposite sides of the second conductor.

10. The connector of claim 1, wherein the first hook portion is adapted to extend around the first conductor in a first direction, and the second hook portion is adapted to extend around the second conductor in a second direction, the second direction opposite to the first direction.

11. The connector of claim 1, wherein the first conductive member and the second conductive member are substantially identically formed.

12. The connector of claim 1, wherein the first base portion has a first thickness and the second base portion has a second thickness different than the first thickness.

13. The connector of claim 1, wherein the second base portion comprises a first conductor contact surface, the first base portion comprising a second conductor contact surface, the first conductor contact surface facing the first hook portion and the second conductor contact surface facing the second hook portion.

14. The connector of claim 1, the first conductive member further comprising a hook portion contact surface and a base portion contact surface, wherein the hook portion contact surface and the base portion contact surface of the first conductive member both face a first direction, and the second conductive member further comprising a hook portion contact surface and a base portion contact surface, wherein the hook portion contact surface and the base portion contact surface of the second conductive member both face a second direction that is opposite the first direction.

15. An electrical connector assembly comprising:

a first conductive member comprising a first hook portion and a first base portion, the first hook portion extending from the first base portion;

a second conductive member comprising a second hook portion and a second base portion, the second hook portion extending from the second base portion; and a wedge member nested between the first and second base portions, the wedge member movable in a loading direction, wherein the wedge member drives the first and second base portions away from one another as the wedge member is moved in the loading direction;

wherein the first hook portion and the second base portion cooperate to securely engage a first conductor therebetween and wherein the second hook portion and the first base portion cooperate to securely engage a second conductor therebetween, and wherein the wedge member loads the first and second hook portions with potential energy by elastically deforming the first and second hook portions against the first and second conductors.

16. An electrical connector assembly comprising:

a first conductive member and a second conductive member separately fabricated from one another, each of the first and second conductive members comprising a base portion and a deflectable hook portion extending from the base portion, the base portion and the hook portion of each conductive member forming a channel, the channel extending between a base end and a hook end, wherein the base portion of the first conductive member is nested at the base end of the channel in the second conductive member and the base portion of the second conductive member is nested at the base end of the channel in the first conductive member, and wherein the hook portion of the first conductive member is adapted to receive a first conductor at the conductor end of the channel in the first conductive member, and the hook portion of the second conductive member is adapted to receive a second conductor at the conductor end of the channel in the second conductive member; and a wedge member variably positionable between the base portions of the first and second conductive members for controlling the relative positions of the first and second conductive members.

17. The connector of claim 16, wherein the channels are parallel to one another.

18. The connector of claim 16, wherein the wedge member is movable in a loading direction, the wedge member reducing relative sizes of the first and second conductor channels as the wedge member is moved in the loading direction.

19. The connector of claim 16, wherein each base portion includes a tapered wedge slot, the wedge member being received within the tapered wedge slots.

20. The connector of claim 16, wherein the first conductive member and the second conductive member are substantially identically formed.

* * * * *